US010743729B1

(12) United States Patent
Tendeng

(10) Patent No.: US 10,743,729 B1
(45) Date of Patent: Aug. 18, 2020

(54) AUTOMATIC TOILET SEAT LIFTING SYSTEM

(71) Applicant: Birahim Tendeng, New York, NY (US)

(72) Inventor: Birahim Tendeng, New York, NY (US)

( * ) Notice: Subject to any disclaimer, the term of this patent is extended or adjusted under 35 U.S.C. 154(b) by 23 days.

(21) Appl. No.: 16/242,160

(22) Filed: Jan. 8, 2019

(51) Int. Cl.
*A47K 13/10* (2006.01)
*A47K 13/12* (2006.01)

(52) U.S. Cl.
CPC ..... *A47K 13/10* (2013.01); *A47K 13/12* (2013.01)

(58) Field of Classification Search
CPC ..... A47K 13/10; A47K 13/12
USPC ..... 4/246.1
See application file for complete search history.

(56) References Cited

U.S. PATENT DOCUMENTS 5,388,281 A * 2/1995 Wiklund ..... A47K 13/10 4/246.2
5,878,444 A * 3/1999 Convoy ..... A47K 13/10 4/246.1
6,643,852 B1 11/2003 Lin
7,788,741 B2 9/2010 Lohss
7,917,973 B2 4/2011 Baumoel
8,640,268 B2 2/2014 Shek
8,739,321 B2 6/2014 Trout
8,910,320 B2 12/2014 Stauber
2007/0056084 A1 3/2007 Watt
2009/0106885 A1 4/2009 Sarge
2009/0106886 A1 4/2009 Jung
2009/0188029 A1* 7/2009 Ta ..... A47K 13/10 4/246.1
2010/0306910 A1* 12/2010 Chen ..... A47K 13/10 4/246.1
2011/0145985 A1* 6/2011 Lin ..... A47K 13/10 4/246.1
2019/0000284 A1* 1/2019 Morikawa ..... A47K 13/00

FOREIGN PATENT DOCUMENTS

EP 2433535 3/2012

* cited by examiner

*Primary Examiner* — Huyen D Le
(74) *Attorney, Agent, or Firm* — Kyle A. Fletcher, Esq.

(57) ABSTRACT

The automated toilet seat lifting system comprises a toilet and a lifting mechanism. The lifting mechanism attaches to the toilet. The toilet further comprises a tank, bowl, toilet seat, and a toilet lid. The lifting mechanism is an automated device used to raise and lower the toilet seat and the toilet lid in preparation for and during the use of the toilet. The lifting mechanism operates such that the toilet seat and toilet lid are raised when a client is detected in the proximity of the toilet. The lifting mechanism returns the toilet seat to a lowered position when the client is no longer detected in the proximity of the toilet.

16 Claims, 7 Drawing Sheets

AUTOMATIC TOILET SEAT LIFTING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including furniture such as sanitary equipment, more specifically, a device for raising and lowering a toilet seat. (A47K13/105)

SUMMARY OF INVENTION

The automated toilet seat lifting system comprises a toilet and a lifting mechanism. The lifting mechanism attaches to the toilet. The toilet further comprises a tank, bowl, toilet seat, and a toilet lid. The lifting mechanism is an automated device used to raise and lower the toilet seat and the toilet lid in preparation for and during the use of the toilet. The lifting mechanism operates such that the toilet seat and toilet lid are raised when a client is detected in the proximity of the toilet. The lifting mechanism returns the toilet seat to a lowered position when the client is no longer detected in the proximity of the toilet.

These together with additional objects, features and advantages of the automated toilet seat lifting system will be readily apparent to those of ordinary skill in the art upon reading the following detailed description of the presently preferred, but nonetheless illustrative, embodiments when taken in conjunction with the accompanying drawings.

In this respect, before explaining the current embodiments of the automated toilet seat lifting system in detail, it is to be understood that the automated toilet seat lifting system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the automated toilet seat lifting system.

It is therefore important that the claims be regarded as including such equivalent construction insofar as they do not depart from the spirit and scope of the automated toilet seat lifting system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
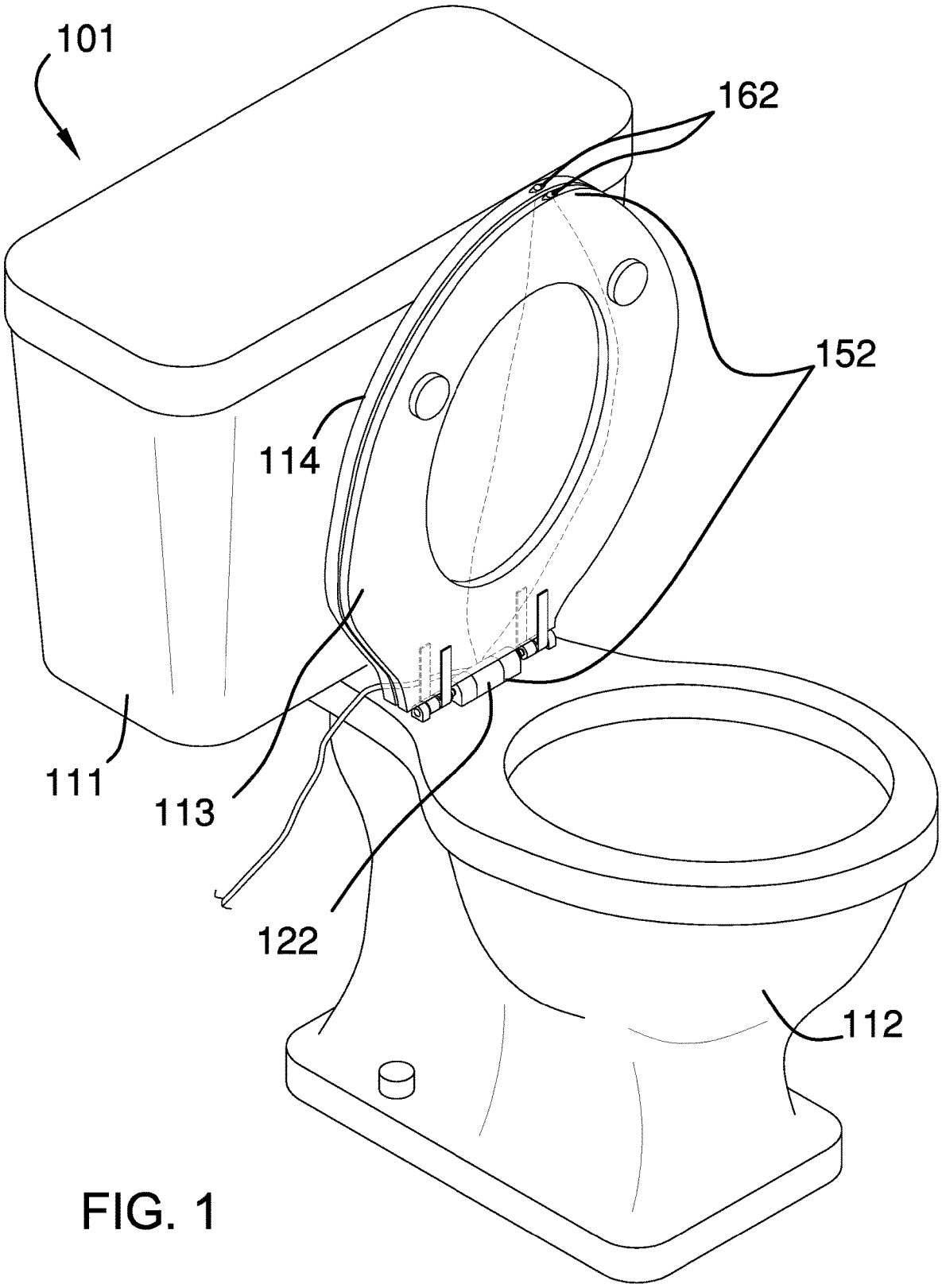
FIG. 1 is a perspective view of an embodiment of the disclosure.
Figure 2:
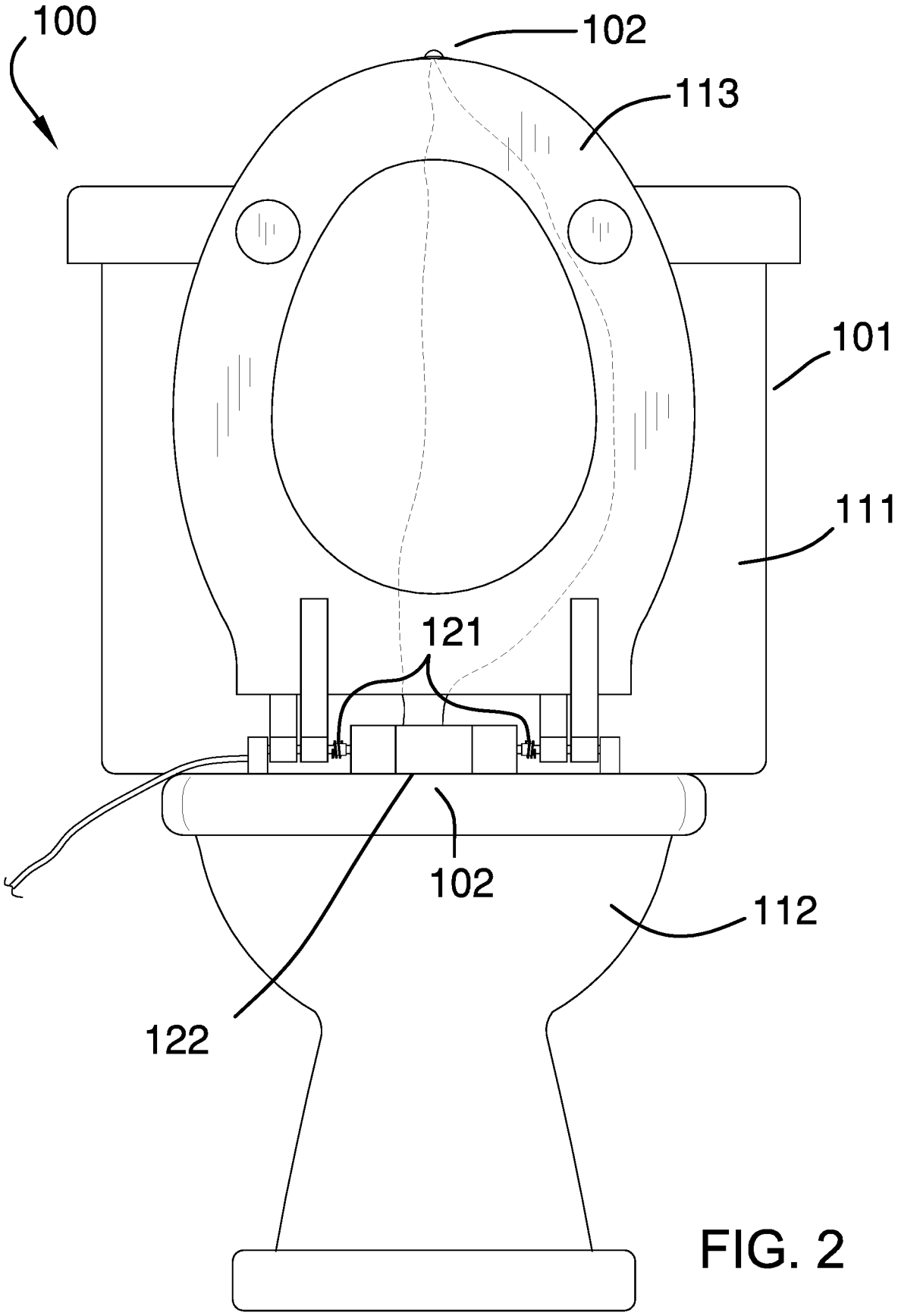
FIG. 2 is a front view of an embodiment of the disclosure.
Figure 3A:
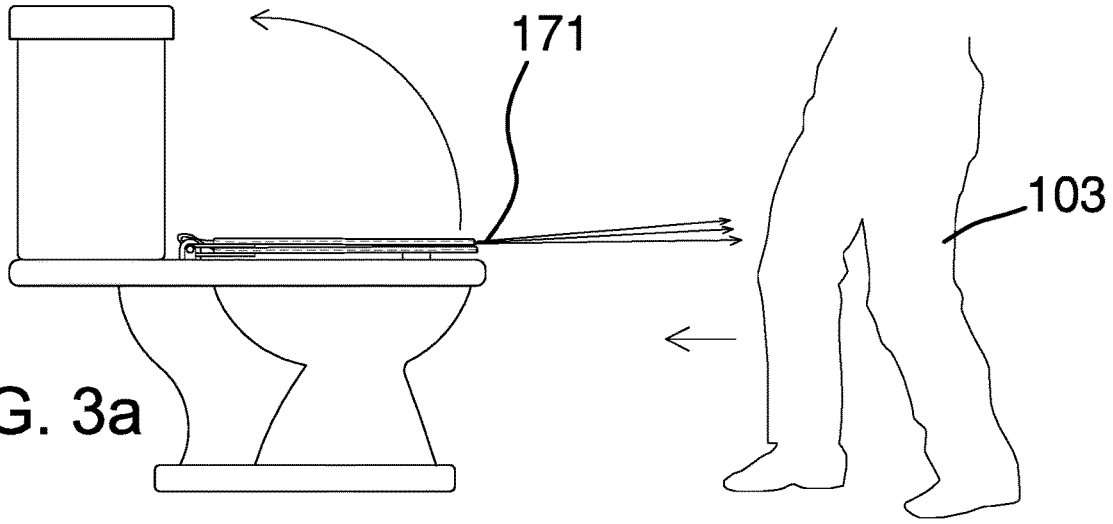
FIG. 3*a* is an in-use view of an embodiment of the disclosure.
Figure 3B:
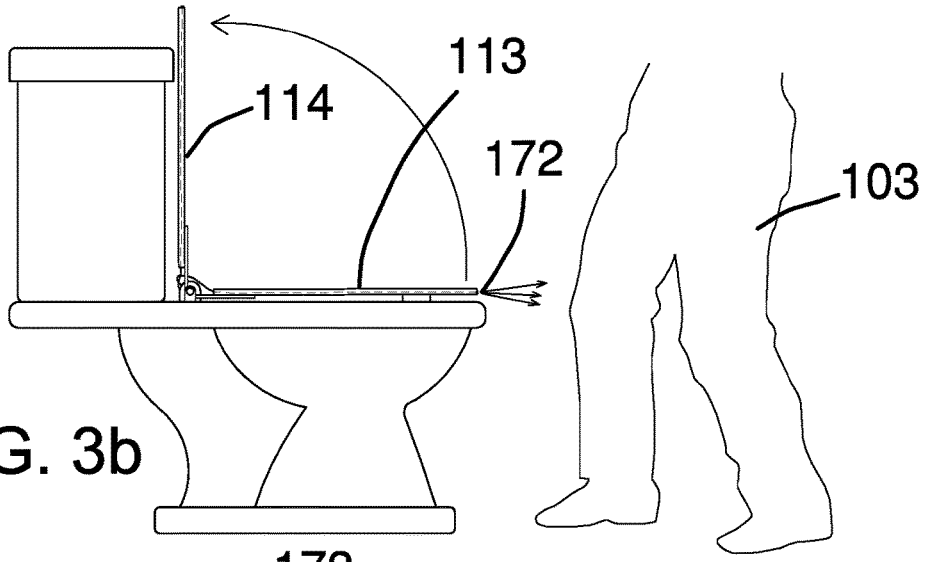
FIG. 3*b* is an in-use view of an embodiment of the disclosure.
Figure 3C:
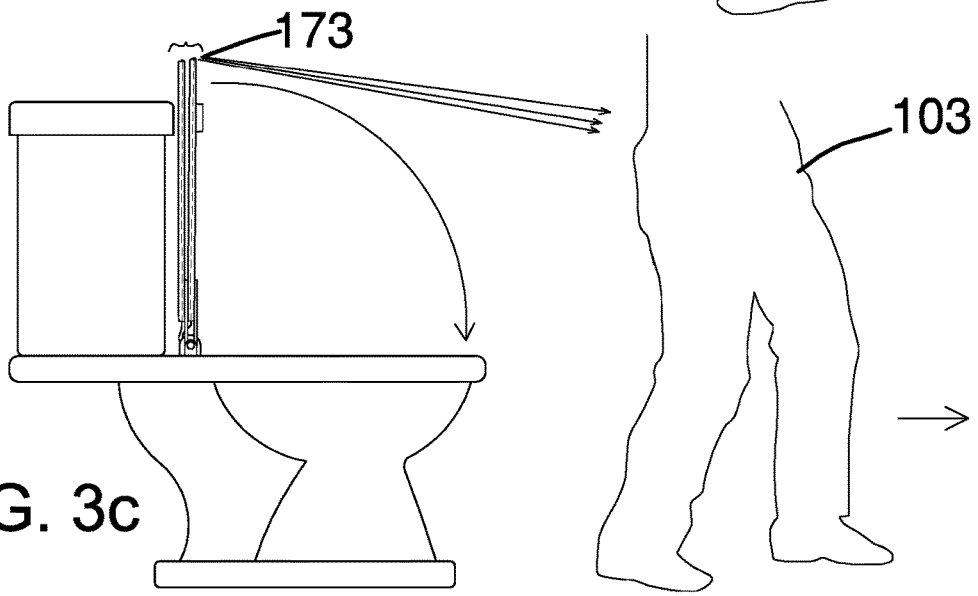
FIG. 3*c* is an in-use view of an embodiment of the disclosure.
Figure 4:
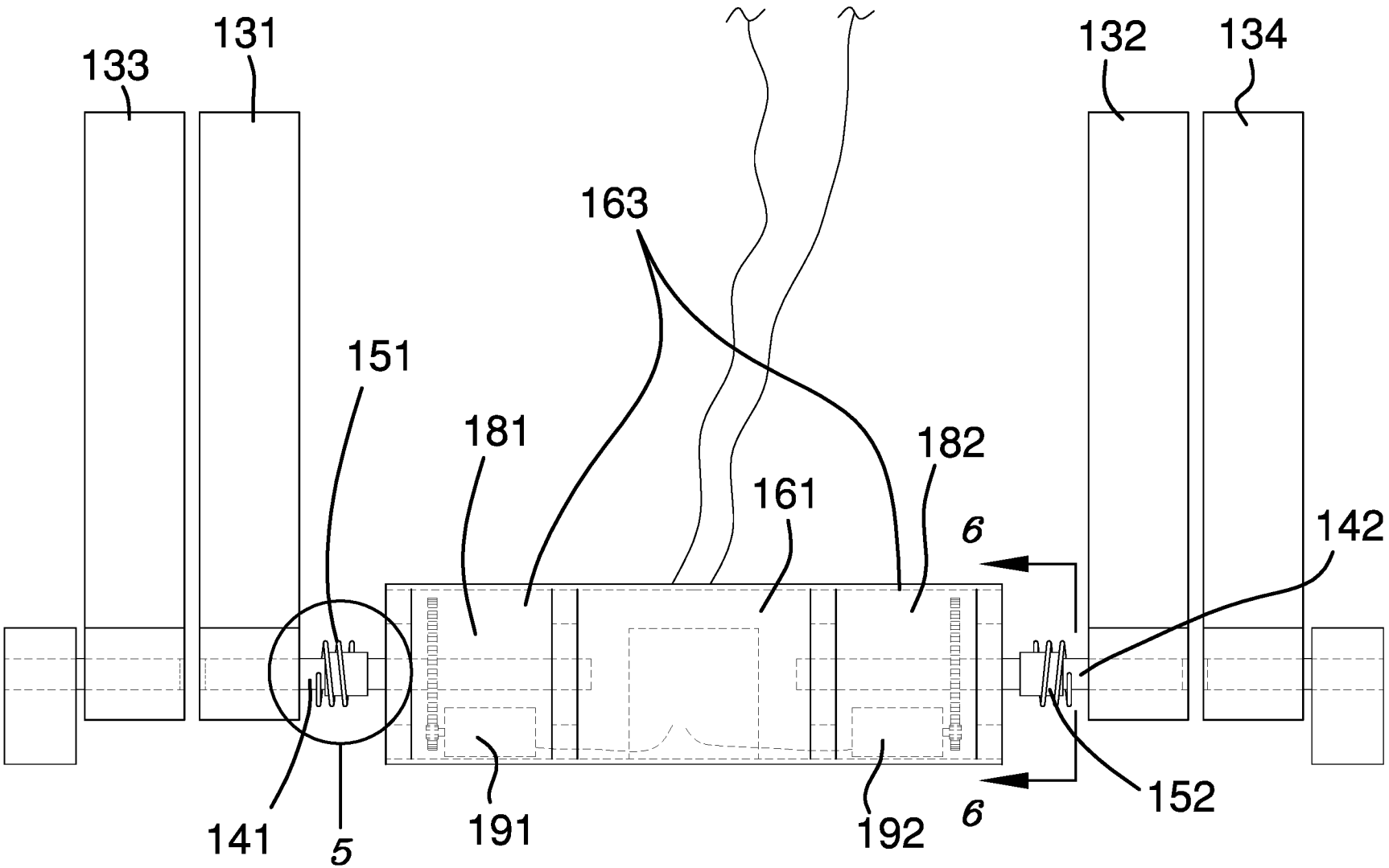
FIG. 4 is a detail view of an embodiment of the disclosure.
Figure 5:
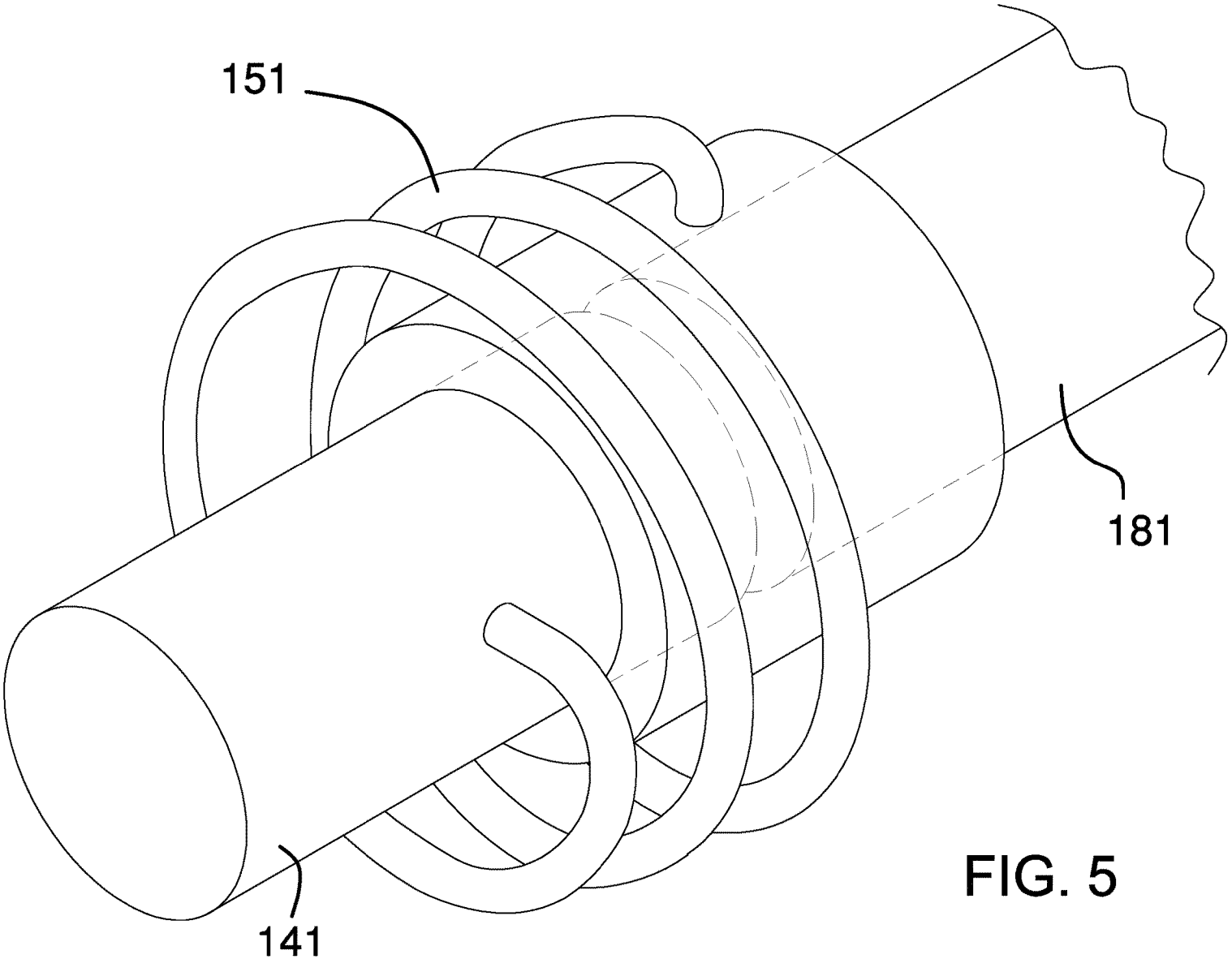
FIG. 5 is a detail view of an embodiment of the disclosure.
Figure 6:
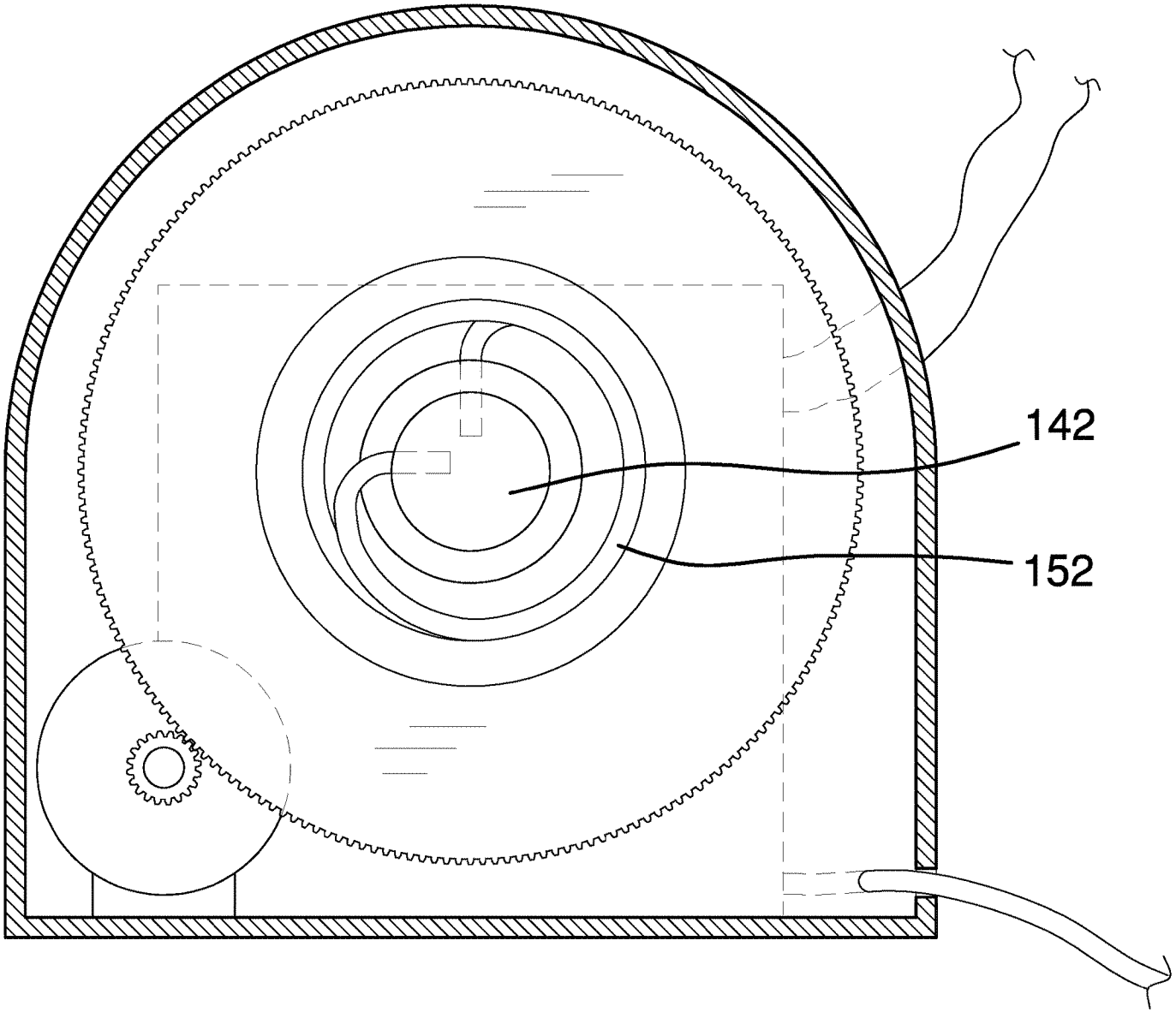
FIG. 6 is a cross-sectional view of an embodiment of the disclosure across 6-6 as shown in FIG. 4.
Figure 7:
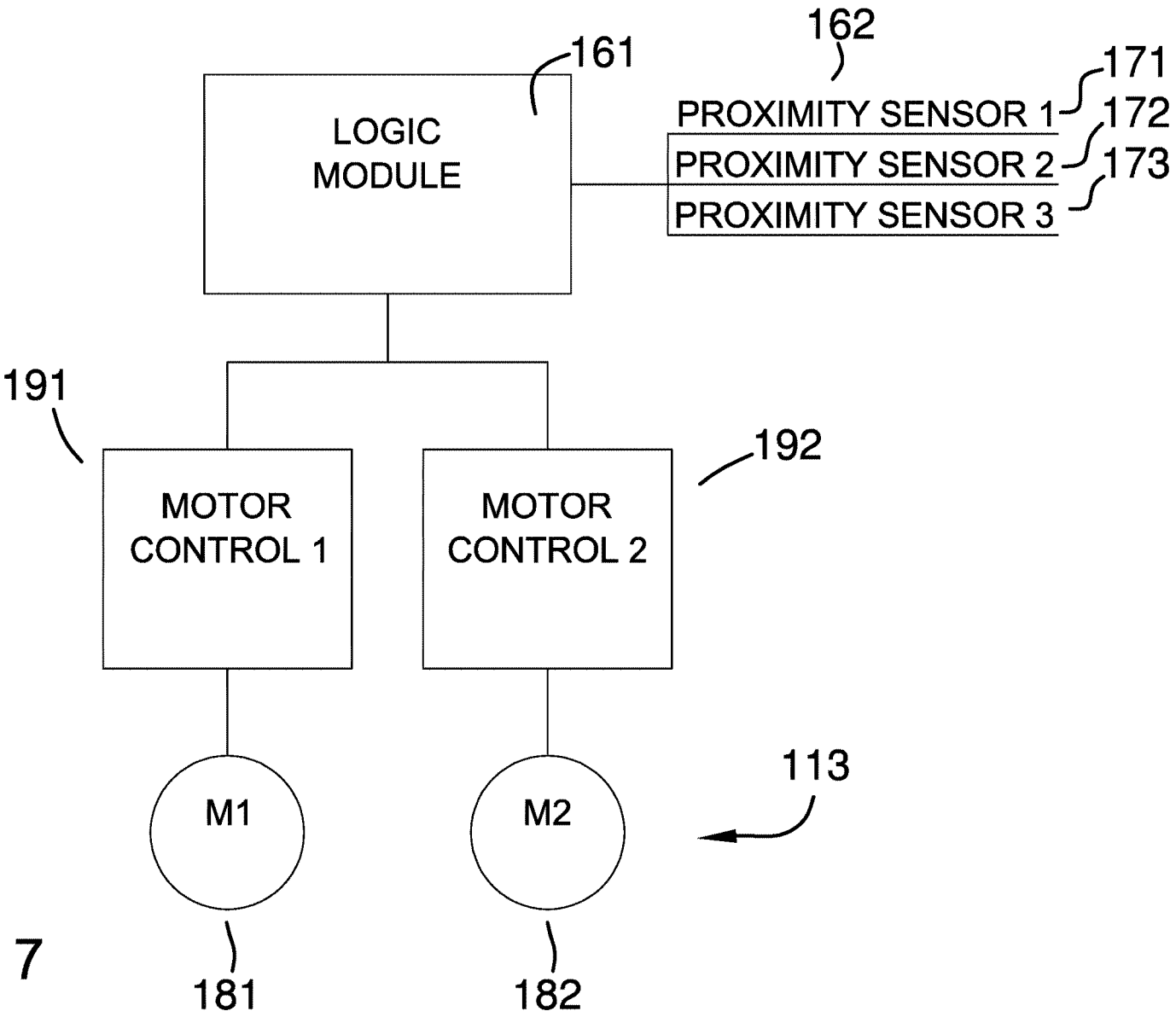
FIG. 7 is a block diagram of an embodiment of the disclosure.

Detailed reference will now be made to one or more potential embodiments of the disclosure, which are illustrated in FIGS. 1 through 7.

The automated toilet seat lifting system 100 (hereinafter invention) comprises a toilet and a lifting mechanism 102. The invention 100 is adapted for use with a client 103. The lifting mechanism 102 attaches to the toilet 101. The toilet 101 further comprises a tank 111, bowl 112, toilet seat 113 and a toilet lid 114. The lifting mechanism 102 is an automated device used to raise and lower the toilet seat 113 and the toilet lid 114 in preparation for and during the use of the toilet 101. The lifting mechanism 102 operates such that the toilet seat 113 and toilet lid 114 are raised when the client 103 is detected in the proximity of the toilet 101. The lifting mechanism 102 returns the toilet 101 seat 113 to a lowered position when the client 103 is no longer detected in the proximity of the toilet 101.

The toilet 101 is a port used to receive from the client 103 a deposit selected from the group consisting of an elimination, an excretion, and a combination of an elimination and an excretion. The toilet 101 transports the received deposit to the DWV of a residential plumbing system. The toilet 101 is defined in greater detail elsewhere in this disclosure. The DWV is defined in greater detail elsewhere in this disclosure. The client 103 is an individual who is using the services of the toilet 101 to make the deposit selected from the group consisting of an elimination, an excretion, and a combination of an elimination and an excretion.

The toilet 101 comprises a tank 111, a bowl 112, a toilet 101 seat 113, and a toilet lid 114.

The tank 111 is an elevated containment structure. The tank 111 contains a volume of water. The tank 111 rapidly drains the contained water into the bowl 112 such that the draining water creates a suction that draws a deposit selected from the group consisting of an elimination, an excretion, and a combination of an elimination and an excretion that is contained in the bowl 112 into the DWV for disposal.

The bowl 112 is an open-faced containment vessel. The bowl 112 forms a repository into which a deposit selected from the group consisting of an elimination, an excretion, and a combination of an elimination and an excretion is received from the client 103.

The toilet seat 113 is a structure that attaches to the superior surface of the bowl 112. The toilet seat 113 allows a client 103 to sit over the opening formed in the bowl 112 when making a deposit selected from the group consisting of an elimination, an excretion, and a combination of an elimination and an excretion into the bowl 112. The design of the toilet seat 113 allows the toilet seat 113 to rotate relative to the bowl 112. The toilet seat 113 further comprises a first hinge 131 and a second hinge 132.

The first hinge 131 is a commercially available hardware item. The first hinge 131 attaches the toilet seat 113 to the bowl 112 of the toilet 101 such that the toilet seat rotates relative to the bowl 112. The first hinge 131 further comprises a first pivot 141. The first pivot 141 is the shaft of the first hinge 131 around which the toilet seat 113 rotates.

The second hinge 132 is a commercially available hardware item. The second hinge 132 attaches the toilet seat 113 to the bowl 112 of the toilet 101 such that the toilet seat rotates relative to the bowl 112. The second hinge 132 further comprises a second pivot 142. The second pivot 142 is the shaft of the second hinge 132 around which the toilet seat 113.

The toilet lid 114 is a plate structure. The toilet lid 114 is positioned on the superior surface of the toilet seat 113. The toilet lid 114 rotates relative to the toilet seat 113. The rotation of the toilet seat 113 raises and lowers the toilet lid 114. The toilet lid 114 further comprises a third hinge 133 and a fourth hinge 134.

The third hinge 133 is a commercially available hardware item. The third hinge 133 attaches the toilet lid 114 to the bowl 112 of the toilet 101 such that the toilet lid 114 rotates relative to the bowl 112. The third hinge 133 attaches the toilet lid 114 to the bowl of the toilet 101 such that the toilet lid 114 rotates relative to the toilet seat 113. The fourth hinge 134 is a commercially available hardware item. The fourth hinge 134 attaches the toilet lid 114 to the bowl 112 of the toilet 101 such that the toilet lid 114 rotates relative to the bowl 112. The fourth hinge 134 attaches the toilet lid 114 to the bowl 112 of the toilet 101 such that the toilet lid 114 rotates relative to the toilet seat 113.

The lifting mechanism 102 is an automated structure that raises and lowers the toilet seat 113 and the toilet lid 114. The lifting mechanism 102 senses the presence of the client 103. The lifting mechanism 102 raises the toilet seat 113 and the toilet lid 114 in response to detecting the client 103 in response to detecting the client 103. The lifting mechanism 102 lowers the toilet seat 113 when the client 103 is no longer detected. The lifting mechanism 102 comprises a plurality of torsion springs 121 and a control system 122.

Each of the plurality of torsion springs 121 is a torsion spring. Each of the plurality of torsion springs 121 attach to the toilet seat 113 such that each torsion spring is in a deformed position when the toilet seat 113 is in a raised position. Each of the plurality of torsion springs 121 returns the toilet seat 113 to a lowered position in the event of a failure of the control system 122 of the lifting mechanism 102. Each of the plurality of torsion springs forms a dampening structure that absorbs transient impulses that may be created by energy overloads created within the control system 122 of the lifting mechanism 102. The plurality of torsion springs 121 comprises a first torsion spring 151 and a second torsion spring 152.

The first torsion spring 151 is a commercially available torsion spring. The first torsion spring 151 attaches to the first pivot 141 such that the first torsion spring 151 is deformed as the control system 122 raises the toilet seat 113. The first torsion spring 151 returns to its relaxed shape as the toilet seat 113 rotates towards a lowered position.

The second torsion spring 152 is a commercially available torsion spring. The second torsion spring 152 attaches to the second pivot 142 such that the second torsion spring 152 is deformed as the control system 122 raises the toilet seat 113. The second torsion spring returns to its relaxed shape as the toilet seat 113 rotates towards a lowered position. The control system 122 is an electromechanical device. The control system 122 detects the presence of the client 103. The control system 122 further rotates the toilet seat 113 relative to the bowl 112 in response to the detection of the client 103. The control system 122 comprises a logic module 161, a plurality of proximity sensors 162, and a plurality of motors 163.

The logic module 161 is an electrical circuit. In the first potential embodiment of the disclosure, the logic module 161 is a non-programmable electrical circuit. The logic module 161 controls the operation of the control system 122. The logic module 161 monitors each of the plurality of proximity sensors 162. The logic module 161 controls the operation of each of the plurality of motors 163.

Each of the plurality of proximity sensors 162 is an electrical sensor. Each of the plurality of proximity sensors 162 is a proximity sensor that is configured to detect the client when the client 103 is in the field of view of the proximity sensor. The entry and exit of the client 103 into and out of the field of view of a proximity sensor selected from the plurality of proximity sensors 162 causes to selected proximity sensor to generate an electrical signal that is detected by the logic module 161.

The detection by the logic module 161 of an electrical signal from a proximity sensor selected from the plurality of proximity sensors 162 causes the logic module 161 to take an action selected from the group consisting of: a) initiating the operation of the plurality of motors 163 to rotate the toilet seat 113 in a direction that raises the toilet seat 113 and the toilet lid 114; and, b) initiating the operation of the plurality of motors 163 to rotate the toilet seat 113 in a direction that lowers the toilet seat 113.

The plurality of proximity sensors 162 comprises a first proximity sensor 171, a second proximity sensor 172, and a third proximity sensor 173.

The first proximity sensor 171 is a proximity sensor. The first proximity sensor 171 mounts on the toilet lid 114 such that the field of view of the first proximity sensor 171 is parallel to the horizontal plane when the toilet lid 114 is in a lowered position. The axis formed by the equal bifurcation of the field of view of the first proximity sensor 171 projects perpendicularly away from the tank 111 of the toilet 101 when the toilet lid 114 is in the lowered position. The electrical signal generated by the entry of the client 103 into the field of view of the first proximity sensor 171 triggers the logic module 161 to rotate the toilet 101 seat such that the toilet seat 113 and the toilet 101 lid 114 are raised The second proximity sensor 172 is a proximity sensor. The second proximity sensor mounts on the toilet seat 113 such that the field of view of the second proximity sensor 172 is parallel to the horizontal plane when the toilet seat 113 is in a lowered position. The axis formed by the equal bifurcation of the field of view of the second proximity sensor 172 projects perpendicularly away from the tank 111 of the toilet 101 when the toilet seat 113 is in the lowered position. The electrical signal generated by the entry of the client 103 into the field of view of the second proximity sensor 172 triggers the logic module to rotate the toilet seat 113 such that the toilet seat 113 and the toilet lid 114 are raised.

The third proximity sensor 173 is a proximity sensor. The third proximity sensor 173 mounts on the toilet seat 113 such that the field of view of the third proximity sensor 173 is parallel to the horizontal plane when the toilet seat 113 is in a raised position. The axis formed by the equal bifurcation of the field of view of the third proximity sensor 173 projects perpendicularly away from the tank 111 of the toilet 101 when the toilet seat 113 is in the raised position. The electrical signal generated by the entry of the client 103 into the field of view of the third proximity sensor 173 triggers the logic module 161 to rotate the toilet seat 113 such that the toilet seat 113 is lowered.

Each of the plurality of motors 163 is an electric motor. The logic module 161 controls the operation of each of the plurality of motors 163. The rotor of each of the plurality of motors 163 attaches to a pivot selected from the group consisting of the first pivot 141 and the second pivot 142. The rotation of each of the plurality of motors 163 rotates the pivot associated with the selected motor. The plurality of motors 163 comprises a first electric motor and a second electric motor 182.

The first electric motor 181 attaches to the first pivot 141 such that the rotation of the rotor of the first electric motor 181 rotates the first pivot 141 which in turn rotates the toilet seat 113. The first electric motor 181 mounts on the toilet bowl 112. The first electric motor 181 further comprises a first motor controller 191. The first motor controller 191 is an electrical circuit that controls the operation of the first electric motor 181. The logic module controls the operation of the first motor controller 191.

The second electric motor 182 attaches to the second pivot 142 such that the rotation of the rotor of the second electric motor 182 rotates the second pivot 142 which in turn rotates the toilet seat 113. The second electric motor 182 mounts on the toilet bowl 112. The second electric motor 182 further comprises a second motor controller 192. The second motor controller 192 is an electrical circuit that controls the operation of the second electric motor 182. The logic module 161 controls the operation of the second motor controller 192.

The terms electric motor and motor controller are defined in more detail elsewhere in this disclosure.

The following definitions were used in this disclosure:

Bifurcate: As used in this disclosure, to bifurcate means to divide an object or space into two pieces or segments.

Bowl: As used in this disclosure, a bowl is a rounded hollow structure used to store a liquid.

Client: As used in this disclosure, a client is an individual who is designated to receive the services of the disclosure at bar.

Control System: As used in this disclosure, a control system is a first device or system that manages and regulates the behavior or operation of a second device or system.

Dampening: As used in this disclosure, dampening refers to a structure that: a) reduces the tendency of an object or system to vibrate or oscillate; or, b) reduces the sensitivity of an object or system to impulses.

DWV: As used in this disclosure, DWV is an acronym for drainage, waste, and vent. With a residential plumbing system, DWV refers to the plumbing subnetwork that transports wastewater out of the residence to an appropriate wastewater handling system.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Field of View: As used in this disclosure, a field of view refers to one or more angles which delimits an area from which electromagnetic radiation will be sensed by a person or an image sensor.

Force of Gravity: As used in this disclosure, the force of gravity refers to a vector that indicates the direction of the pull of gravity on an object at or near the surface of the earth.

Hardware: As used in this disclosure, refers to one or more incidental objects: 1) that are readily and commercially available; and, 2) that are associated with the installation, operation or maintenance of a primary object. Always use incidental.

Hinge: As used in this disclosure, a hinge is a device that permits the turning, rotating, or pivoting of a first object relative to a second object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Incidental: As used in this disclosure, incidental refers to a second object that is associated with a first object but that: 1) does not significantly affect the characteristics of the first object; and, 2) the function of which can be readily replaced by or substituted with a third object.

Impulse: As used in this disclosure, an impulse refers to the application of a force over a period of time. The use of the term impulse often implies a relatively short period of time.

Logic Module: As used in this disclosure, a logic module is a readily and commercially available electrical device that accepts digital and analog inputs, processes the digital and analog inputs according to previously specified logical processes and provides the results of these previously specified logical processes as digital or analog outputs. The disclosure allows, but does not assume, that the logic module is programmable.

Motion Sensor: As used in this disclosure, a motion sensor refers to a commercially available sensor that generates an electrical signal should the motion sensor detect movement within its field of view.

Motor: As used in this disclosure, a motor refers to the method of transferring energy from an external power source into rotational mechanical energy.

Motor Controller: As used in this disclosure, a motor controller is an electrical device that is used to control the rotational speed, or simply the speed of the motor, and the direction of rotation of an electric motor. Motor controllers will generally receive one or more inputs which are used determine the desired rotational speed and direction of rotation of the electric motor.

Pivot: As used in this disclosure, a pivot is a rod or shaft around which an object rotates or swings.

Proximity Sensor: As used in this disclosure, a proximity sensor is an electrical device that senses the entry or presence of an object within a previously determined field of view.

Relaxed Shape: As used in this disclosure, a structure is considered to be in its relaxed state when no shear, strain, or torsional forces are being applied to the structure.

Seat: As used in this disclosure, a seat is a structure that a person can sit on. Chair is a common synonym for a seat.

Sensor: As used in this disclosure, a sensor is a device that receives and responds in a predetermined way to a signal or stimulus. As further used in this disclosure, a threshold sensor is a sensor that generates a signal that indicates whether the signal or stimulus is above or below a given threshold for the signal or stimulus.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Tank: As used in this disclosure, a tank is an enclosed hollow structure used to store a fluid.

Toilet: As used in this disclosure, a toilet is a port into which biological excretions and eliminations are deposited for in preparation of introducing the excretions and eliminations into an externally provided wastewater handling system. A typical toilet comprises a bowl, a flush mechanism, and a refill mechanism.

Torsion Spring: As used in this disclosure, a torsion spring is a mechanical device that stores mechanical energy through an opposing torque when the mechanical device is bent or twisted. The torsion spring will return to its original relaxed shape when the twisting force is removed.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An automated device comprising:

a toilet and a lifting mechanism;

wherein the lifting mechanism attaches to the toilet;

wherein the automated device is adapted for use with a client;

wherein the lifting mechanism is used to raise and lower a toilet seat and a toilet lid in preparation for and during the use of the toilet;

wherein the lifting mechanism operates such that the toilet seat and toilet lid are raised when the client is detected in the proximity of the toilet;

wherein the lifting mechanism operates such that the toilet seat returns to a lowered position when the client is no longer detected in the proximity of the toilet;

wherein the toilet further comprises a tank, a bowl, the toilet seat, and the toilet lid;

wherein the tank, the toilet seat, and the toilet lid attach to the bowl;

wherein the lifting mechanism comprises a plurality of torsion springs and a control system;

wherein each of the plurality of torsion springs is a torsion spring;

wherein the control system is an electromechanical device;

wherein the control system detects the presence of the client;

wherein the control system further rotates the toilet seat relative to the bowl in response to the detection of the client;

wherein the control system comprises a logic module, a plurality of proximity sensors, and a plurality of motors;

wherein the logic module, the plurality of proximity sensors, and the plurality of motors are electrically interconnected;

wherein the plurality of proximity sensors comprises a first proximity sensor, a second proximity sensor, and a third proximity sensor;

wherein the first proximity sensor mounts on the toilet lid such that the field of view of the first proximity sensor is parallel to the horizontal plane when the toilet lid is in a lowered position;

wherein the second proximity sensor mounts on the toilet seat such that the field of view of the second proximity sensor is parallel to the horizontal plane when the toilet seat is in a lowered position;

wherein the third proximity sensor mounts on the toilet seat such that the field of view of the third proximity sensor is parallel to the horizontal plane when the toilet seat is in a raised position.

2. The automated device according to claim 1 wherein the lifting mechanism is an automated structure;

wherein the lifting mechanism raises and lowers the toilet seat;

wherein the lifting mechanism raises and lowers the toilet lid.

3. The automated device according to claim 2
wherein the lifting mechanism senses the presence of the client;
wherein the lifting mechanism raises the toilet seat and the toilet lid in response to detecting the client in response to detecting the client;
wherein the lifting mechanism lowers the toilet seat when the client is no longer detected.

4. The automated device according to claim 3
wherein the tank is an elevated containment structure;
wherein the bowl is an open-faced containment vessel;
wherein the toilet seat is a structure that attaches to the superior surface of the bowl;
wherein the toilet lid is a plate structure;
wherein the toilet lid is positioned on the superior surface of the toilet seat.

5. The automated device according to claim 4
wherein the design of the toilet seat rotates relative to the bowl;
wherein the toilet lid rotates relative to the toilet seat;
wherein the rotation of the toilet seat raises and lowers the toilet lid.

6. The automated device according to claim 5
wherein the toilet seat further comprises a first hinge and a second hinge;
wherein the first hinge is a hardware item;
wherein the first hinge attaches the toilet seat to the bowl of the toilet such that the toilet seat rotates relative to the bowl;
wherein the second hinge is a hardware item;
wherein the second hinge attaches the toilet seat to the bowl of the toilet such that the toilet seat rotates relative to the bowl.

7. The automated device according to claim 6
wherein the toilet lid further comprises a third hinge and a fourth hinge;
wherein the third hinge is a hardware item;
wherein the fourth hinge is a hardware item;
wherein the third hinge attaches the toilet lid to the bowl of the toilet such that the toilet lid rotates relative to the bowl;
wherein the third hinge attaches the toilet lid to the bowl of the toilet such that the toilet lid rotates relative to the toilet seat;
wherein the fourth hinge attaches the toilet lid to the bowl of the toilet such that the toilet lid rotates relative to the bowl;
wherein the fourth hinge attaches the toilet lid to the bowl of the toilet such that the toilet lid rotates relative to the toilet seat.

8. The automated device according to claim 7
wherein the first hinge further comprises a first pivot;
wherein the second hinge further comprises a second pivot;
wherein the first pivot is the shaft of the first hinge around which the toilet seat rotates;
wherein the second pivot is the shaft of the second hinge around which the toilet seat.

9. The automated device according to claim 8
wherein each of the plurality of torsion springs attaches to the toilet seat such that each torsion spring is in a deformed position when the toilet seat is in a raised position;
wherein each of the plurality of torsion springs returns the toilet seat to a lowered position in the event of a failure of the control system of the lifting mechanism.

10. The automated device according to claim 9
wherein the plurality of torsion springs comprises a first torsion spring and a second torsion spring;
wherein the first torsion spring attaches to the first pivot;
wherein the second torsion spring attaches to the second pivot.

11. The automated device according to claim 10
wherein the logic module is a non-programmable electrical circuit;
wherein the logic module controls the operation of the control system;
wherein the logic module monitors each of the plurality of proximity sensors;
wherein the logic module controls the operation of each of the plurality of motors.

12. The automated device according to claim 11
wherein each of the plurality of proximity sensors is an electrical sensor;
wherein each of the plurality of proximity sensors is configured to detect the client when the client is in the field of view of the proximity sensor;
wherein the entry and exit of the client into and out of the field of view of a proximity sensor selected from the plurality of proximity sensors causes to selected proximity sensor to generate an electrical signal that is detected by the logic module;
wherein the detection by the logic module of an electrical signal from a proximity sensor selected from the plurality of proximity sensors causes the logic module to take an action selected from the group consisting of: a) initiating the operation of the plurality of motors to rotate the toilet seat in a direction that raises the toilet seat and the toilet lid; and, b) initiating the operation of the plurality of motors to rotate the toilet seat in a direction that lowers the toilet seat.

13. The automated device according to claim 12
wherein each of the plurality of motors is an electric motor;
wherein the logic module controls the operation of each of the plurality of motors;
wherein each of the plurality of motors attaches to a pivot selected from the group consisting of the first pivot and the second pivot;
wherein the rotation of each of the plurality of motors rotates the pivot associated with the selected motor.

14. The automated device according to claim 13
wherein the axis formed by the equal bifurcation of the field of view of the first proximity sensor projects perpendicularly away from the tank of the toilet when the toilet lid is in the lowered position;
wherein the axis formed by the equal bifurcation of the field of view of the second proximity sensor projects perpendicularly away from the tank of the toilet when the toilet seat is in the lowered position;
wherein the axis formed by the equal bifurcation of the field of view of the third proximity sensor projects perpendicularly away from the tank of the toilet when the toilet seat is in the raised position.

15. The automated device according to claim 14
wherein the electrical signal generated by the entry of the client into the field of view of the first proximity sensor triggers the logic module to rotate the toilet seat such that the toilet seat and the toilet lid are raised;
wherein the electrical signal generated by the entry of the client into the field of view of the second proximity sensor triggers the logic module to rotate the toilet seat such that the toilet seat and the toilet lid are raised;

wherein the electrical signal generated by the entry of the client into the field of view of the third proximity sensor triggers the logic module to rotate the toilet seat such that the toilet seat is lowered.

16. The automated device according to claim 15 wherein the plurality of motors comprises a first electric motor and a second electric motor;

wherein the first electric motor attaches to the first pivot such that the rotation of the rotor of the first electric motor rotates the first pivot which in turn rotates the toilet seat;

wherein the first electric motor mounts on the toilet bowl;

wherein the first electric motor further comprises a first motor controller;

wherein the first motor controller is an electrical circuit that controls the operation of the first electric motor;

wherein the logic module controls the operation of the first motor controller;

wherein the second electric motor attaches to the second pivot such that the rotation of the rotor of the second electric motor rotates the second pivot which in turn rotates the toilet seat;

wherein the second electric motor mounts on the toilet bowl;

wherein the second electric motor further comprises a second motor controller;

wherein the second motor controller is an electrical circuit that controls the operation of the second electric motor;

wherein the logic module controls the operation of the second motor controller.

* * * * *